United States Patent [19]

Khan

[11] Patent Number: 4,914,420

[45] Date of Patent: Apr. 3, 1990

[54] TELECOMMUNICATION SYSTEM INCLUDING A REMOTE ALARM REPORTING UNIT

[75] Inventor: Salim M. Khan, St. Joseph, Ill.

[73] Assignee: Siemens Transmission Systems, Inc., Tempe, Ariz.

[21] Appl. No.: 163,907

[22] Filed: Mar. 3, 1988

[51] Int. Cl.[4] ..... G08B 29/00

[52] U.S. Cl. ..... 340/516; 340/825.17; 340/505; 250/551

[58] Field of Search ..... 340/505, 825.17, 504, 340/514–516, 653; 250/551; 364/413.02, 413.03, 413.05, 413.06, 514, 551.01

[56] References Cited

U.S. PATENT DOCUMENTS

| | | | |
|---|---|---|---|
| 3,324,458 | 6/1967 | MacArthur | 340/825.06 |
| 3,634,824 | 1/1972 | Zinn | 340/825.17 |
| 3,686,653 | 8/1972 | Salenbien et al. | 340/825.17 |
| 3,697,953 | 10/1972 | Schoenwitz | 340/825.17 |
| 3,832,688 | 8/1974 | Strojny et al. | 340/825.06 |
| 4,216,462 | 8/1980 | McGrath | 340/870.11 |
| 4,298,839 | 11/1981 | Johnston | 250/551 |
| 4,412,292 | 10/1983 | Sedam et al. | 340/825.36 |
| 4,742,334 | 5/1988 | Teich et al. | 340/505 |

*Primary Examiner*—Joseph A. Orsino
*Assistant Examiner*—Jill D. Jackson
*Attorney, Agent, or Firm*—David N. Caracappa

[57] ABSTRACT

A telecommunication system is provided consisting of a plurality of functional units each one producing a status signal. A maintenance processor is coupled to each of the functional units and receives the status signals. This processor produces signals representative of the status of the system. A remote alarm reporting unit is coupled to the processor and generates optically isolated alarm signals corresponding to the status representative signals generated by the processor.

14 Claims, 5 Drawing Sheets

TELECOMMUNICATION SYSTEM INCLUDING A REMOTE ALARM REPORTING UNIT

The present invention relates to a telecommunication system including a remote alarm reporting unit which gathers status signals from other units comprising the system and reports them to a remote diagnostic tester.

Various types of telecommunications equipment (for example terminals, repeaters, switches or multiplexers) may be constructed from various units each performing a different subfunction required by the system. For example, a digital multiplexer may require low speed digital signal input units and high speed digital signal output units (among others). In order to monitor the overall operational status of such a multiplexer, the operational status of each unit must be made available to a remote diagnostic tester.

It has been proposed that the operational status of the equipment be reported to the remote diagnostic tester over a serial digital data link. This minimizes the number of connections required on a backplane of the telecommunications equipment. This method however requires additional hardware in both the telecommunications equipment and the remote diagnostic tester and is a relatively slow method for transmitting the status.

It is also generally necessary to maintain electrical isolation between the telecommunications equipment and the remote diagnostic tester. In the past, relays have been used for transmitting this status while maintaining electrical isolation. Relays however consume relatively large amounts of power and require a relatively large area on a printed circuit board and are also relatively slow.

In accordance with principles of the present invention, a telecommunications system comprises a plurality of functional units, each one producing a status signal. A maintenance processor is coupled to each of the functional units to receive the status signals. This processor produces signals representative of the status of the system. A remote alarm reporting unit is coupled to the processor and generates optically isolated alarm signals corresponding to the status representative signals generated by the processor.

Figure 1:
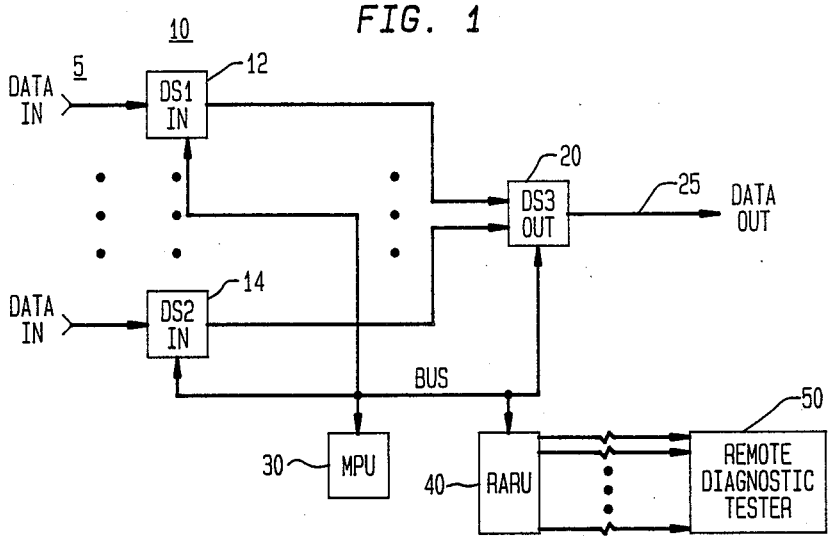
FIG. 1 is a block diagram of a telecommunications system in accordance with principles of the present invention.

The telecommuncation equipment illustrated in FIG. 1 is part of a multiplexer. The multiplexer illustrated will multiplex some combination of lower speed digital signals into a single higher speed digital signal. Only the functional units necessary for understanding the operation of the remote alarm reporting unit of the invention are illustrated for the sake of simplicity.

In FIG. 1 several digital data input terminals 5 are coupled to sources (not shown) of low speed digital data. Digital data input terminals 5 are coupled to input terminals of respective low speed digital signal input processing units 10. For example, low speed digital signal input processing unit 12 receives a standard DS-1 signal. Low speed digital signal input processing unit 14 receives a standard DS-2 digital signal. Respective output terminals from the low speed digital signal input processors 10 are coupled to corresponding input terminals of a high speed digital signal output processor 20. High speed digital signal output processing unit 20, for example, produces a standard DS-3 digital signal.

Each of the digital signal processing units (DSl IN, DS2 IN, DS3 OUT) may produce a status signal which indicates the operational status of that unit. A maintenance processor unit (MPU) 30 is coupled via a data bus to each of the digital signal processing units. The MPU 30 is configured to retrieve the status signals from the digital signal processing units via the bus. The MPU 30 may then process the retrieved status signals to produce a signal which represents the overall status of the complete system.

The MPU 30 then supplies the status representative signal to a remote alarm reporting unit (RARU) 40 via the bus. The RARU 40 generates optically isolated alarm signals at a plurality of output terminals which correspond to the status representative signals from the bus. These optically isolated alarm signals are coupled to a remote diagnostic tester 50. Personnel operating the remote diagnostic tester 50 may then diagnose any alarm signals reported by the telecommunications system.

Figure 2:
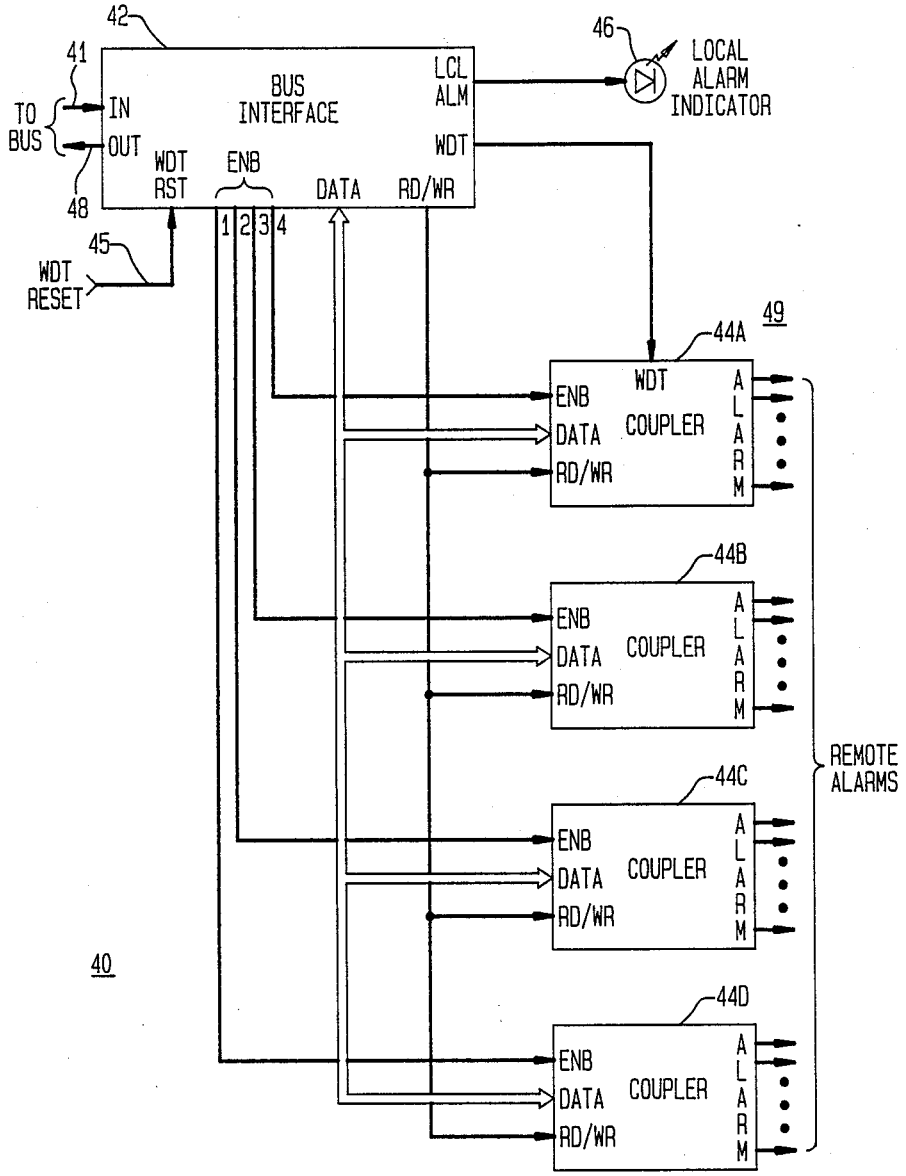
FIG. 2 is a block diagram of a remote alarm reporting unit (RARU) which may be used in the system illustrated in FIG. 1.
Figure 3:
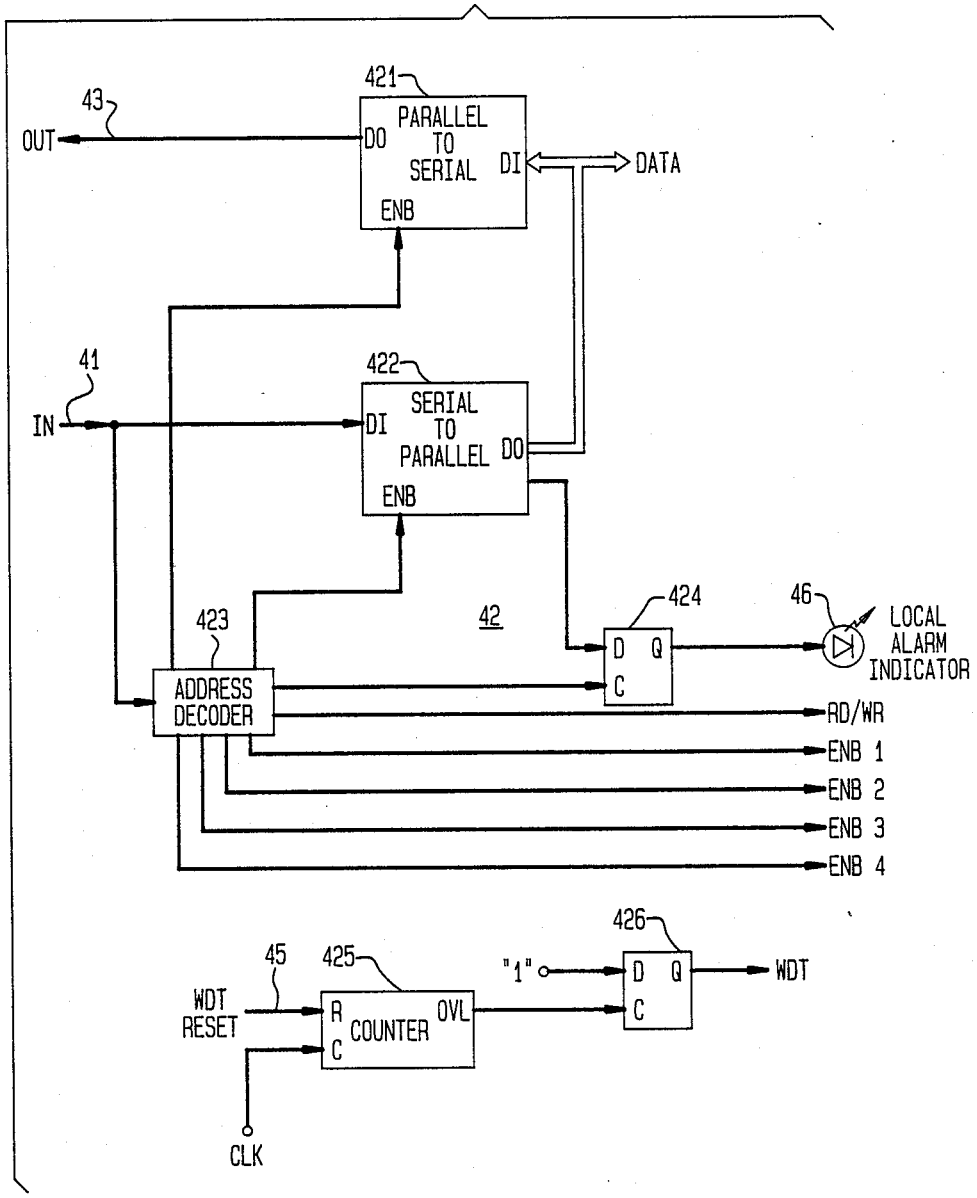
FIG. 3 is a block diagram of bus interface circuit which may be used in the remote alarm reporting unit illustrated in FIG. 2.
Figure 4:
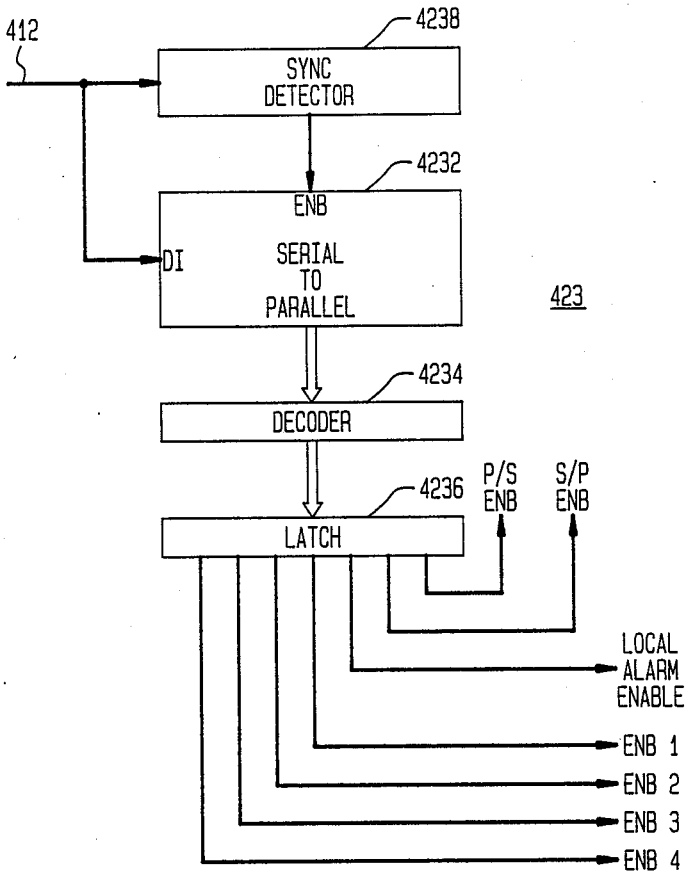
FIG. 4 is a block diagram of an address decoder which may be used in the bus interface circuit illustrated in FIG. 3.

FIG. 2 is a block diagram of a RARU 40 as illustrated in FIG. 1. In FIGS. 2, 3 and 4, single bit digital signal connections and analog signal connections are illustrated as thin lines. Multibit digital signal connections are illustrated as thick lines. In FIG. 2, an input terminal 41, an output terminal 43 and a watch dog timer (WDT) reset terminal 45 are coupled to the bus (not shown) illustrated in FIG. 1. The bus, as illustrated in FIG. 2 passes data in bit serial form. For example, a communication between the MPU 30 (of FIG. 1) is initiated by the MPU placing a command word, in bit serial form, on the bus. The command word contains an address component and an operation code. If the operation code indicates a data transfer from the MPU 30 to the addressed unit, then the command word also contains a data component. If the operation code indicate a data transfer from the addressed unit to the MPU 30, then the addressed unit places the requested data, also in bit serial form, on a different line on the bus. Other forms of bus architectures may be used to transfer information between the MPU 30 and the functional units including parallel digital bus architectures.

Input terminal 41 is coupled to a bit serial input terminal of a bus interface circuit 42. Output terminal 43 is coupled to a bit serial output terminal of bus interface circuit 42. A bi-directional, multibit parallel data terminal of bus interface circuit 42 is coupled to respective bi-directional data terminals of coupler circuits 44A, 44B, 44C, and 44D. Alarm output terminals of coupler circuits 44A–44D are coupled to a plurality of output terminals 49. Output terminals 49 are coupled to corresponding input terminals of the remote diagnostic tester 50 (of FIG. 1).

Respective coupler enable output terminals of bus interface circuit 42 are coupled to enable input terminals of coupler units 44A–44D. In addition, a read/write control (RD/WR) output terminal of bus interface circuit 42 is coupled to respective read/write input terminals of each of the coupler units 44A–44D.

A watchdog timer (WDT) output terminal from bus interface circuit 42 is coupled to a WDT input terminal of coupler unit 44A and a local alarm (LCL ALM) output terminal of bus interface circuit 42 is coupled to a local alarm indicator 46 which may be a light emitting diode (LED).

In operation, bus interface circuit 42 receives command words from the input terminal 41 of the bus. Bus interface circuit 42 responds only when the MPU 30 (of FIG. 1) is either sending data to or requesting data from the RARU 40. If, for example data is being transferred from the MPU 30 to the RARU 40, bus interface circuit 42 assembles the data component from the bit serial bus into parallel form, and places the parallel data on the bi-directional data bus; and configures the bi-directional data bus to transmit data from the bus interface circuit 42. The RD/WR signal is placed in the write mode and the appropriate enable signal ENB is activated to latch the data on the bi-directional data bus into the proper one of coupler circuits 44A–44D. The selected coupler circuit generates an optically isolated signal at its output terminals representative of the written data.

If the MPU 30 (of FIG. 1) is requesting information from the RARU 40, then the bus interface circuit 42 places the RD/WR line into the read mode. The appropriate enable signal ENB is then activated to configure the proper coupler circuit to place the current state of its alarm signals onto the bi-directional bus. Bus interface circuit 42 then reads the data in parallel from the bi-directional data bus and presents it in bit serial form to the bus output terminal 43.

When MPU 30 is operating properly, it will issue repetitive signals over a line coupled to the WDT reset input terminal 45 which are received by the bus interface circuit 42. These signals are generated by software executing within the MPU 30. If no repetitive signals are received within a predetermined period of time, then bus interface circuit 42 assumes that the software within the MPU 30 is operating improperly and generates a signal on the WDT output terminal. The WDT output terminal of bus interface circuit 42 is coupled to a WDT input terminal of coupler circuit 44A. Because the MPU 30 is assumed not operating properly, this status cannot be communicated via the normal, MPU control. Coupler circuit 44A, thus, couples the WDT line directly to an alarm output terminal 49, which is supplied to the remote diagnostic tester 50 (of FIG. 1), ensuring that the MPU 30 malfunction will be reported to the remote diagnostic tester 50. The local alarm indicator 46 provides a method for determining which physical location is reporting a malfunction to the service personnel. The MPU 30 may configure the bus interface circuit 42 to illuminate the local alarm indicator 46 whenever a malfunction is reported over one of the remote alarm terminals 49.

FIG. 3 is a more detailed block diagram of a bus interface circuit 42 which may be used in the RARU 40 illustrated in FIG. 2. Elements similar to those illustrated in FIG. 2 are designated by the same reference number and are not described in described in detail below.

In FIG. 3 input terminal 41 is coupled to a serial data input terminal (DI) of a serial-to-parallel converter 422, and to an input terminal of an address decoder 423. A multibit parallel data output terminal (DO) of serial-to-parallel converter 422 is coupled to the bi-directional data terminal of bus interface circuit 42. This bi-directional data terminal is also coupled to a multibit parallel data input terminal (DI) of a parallel-to-serial converter 421. A serial data output terminal of parallel-to-serial converter 421 is coupled to output terminal 43.

A first and a second output terminal of address decoder 423 are coupled to respective enable input terminals (ENB) of serial-to-parallel converter 422 and parallel-to-serial converter 421. A further output terminal of address decoder 423 is coupled to the read/write (RD/WR) output terminal of bus interface circuit 42. Four further output terminals of address decoder 423 are coupled to the four enable output terminals (ENB-1–ENB4) of bus interface circuit 42. The last output terminal of address decoder 423 is coupled to a clock C input terminal of a D flip-flop 424.

One bit of the multibit parallel data output terminal of serial-to-parallel converter 422 is coupled to the D input terminal of D flip-flop 424. A Q output terminal of D flip-flop 424 is coupled to the input terminal of the local alarm indicator 46.

Watchdog timer (WDT) reset input terminal 45 is coupled to a reset input terminal of a counter 425. An overflow output terminal of counter 425 is coupled to a clock input terminal of a D flip-flop 426. A source of a logic "1" signal is coupled to a D input terminal of D flip-flop 426. A Q output terminal of D flip-flop 426 is coupled to the watchdog timer (WDT) output terminal of bus circuit interface 42. A source of a clock signal (CLK) is coupled to the clock input terminal of counter 425.

Address decoder 423 controls the operation of the various circuits in the bus interface circuit 42. A bit serial command word from input terminal 41 is analysed by address decoder 423. First, the address component is checked to recognize when the RARU is being addressed by the MPU 30. If the RARU is being accessed, then the operation code is checked to determine whether a read or a write operation is being requested by the MPU 30.

If a read operation is requested, then the signal at the RD/WR output terminal is placed in a state to indicate a read operation to the remainder of the RARU 40; an enable signal is sent to the parallel-to-serial converter 421; and the proper enable signal (ENB1–ENB4) is made active. The combination of the active enable signal (ENB1–ENB4) and the read state of the RD/WR line configures the appropriate coupler circuit (44A–44D) to place data on the multibit parallel bi-directional data bus. Parallel-to-serial converter 421 converts the multibit parallel input data to bit serial data supplies the bit serial data to output terminal 43.

If a write operation is being requested then the signal at the RD/WR terminal is placed in a state to indicate a write operation to a remainder of the RARU 40; an enable signal is sent to the serial-to-parallel converter 422; and the proper enable signal (ENB1–ENB4) is made active. Serial-to-parallel converter 422 converts the data component of the bit serial command word into a multibit parallel data word which is supplied to the bi-directional data output terminal. The appropriate coupler circuit 44 (of FIG. 2) is configured by the combination of the write state of the RD/WR line and the active enable signal (ENB1–ENB4) to latch the data from the bi-directional data bus. The converter 44 then produces the appropriate alarm signal at output terminal 49 (of FIG. 2).

If MPU 30 is activating the local alarm indicator 46, none of the enable signals (ENB1–ENB4) are activated. Instead, one of the bits at the output terminal of serial-to-parallel converter 422 is latched in the D flip-flop 424 in response to an internal enable signal generated by the address decoder 423 and supplied to the dock input terminal C. The Q output terminal of D flip-flop 424 activates the local alarm indicator 46.

The watchdog timer reset signal from input terminal 45 operates to reset counter 425 to a zero count. The clock signal at the clock input terminal C of counter 425 begins the counter 425 counting. If the counter 425 reaches a predetermined overflow count, then the signal at the overflow output terminal (OVL) is activated. The overflow signal causes the D flip-flop 426 to latch the logic "1" signal at the D input terminal to the Q output terminal. This signal is supplied to the WDT output terminal of the bus interface circuit 42. The overflow count of counter 425, the clock frequency, and the period of the WDT reset signal may be selected such that several cycles of the WDT reset signal must be missed before the counter reaches its overflow count.

FIG. 4 illustrates an address decoder 423 which may be used in the bus interface circuit 42 illustrated in FIG. 3. In FIG. 4 terminal 41 is coupled to a data input terminal DI of a serial-to-parallel converter 4232 and an input terminal of a sync detector 4238. An output terminal of sync detector 4238 is coupled to an enable input terminal ENB of serial-to-parallel converter 4232. A multibit parallel digital output terminal DO of serial-to-parallel converter 4232 is coupled to an input terminal of a decoder 4234. An output terminal of decoder 4234 is coupled to an input terminal of a latch 4236. Respective output terminals of the latch 4236 are coupled to: the enable input terminal of the parallel-to-serial converter 421; the enable input terminal of the serial-to-parallel converter 422; the clock input terminal of the local alarm D flip-flop 424; and the four enable output terminals (ENB1–ENB4) all as illustrated in FIG. 3.

In operation sync detector 4238 detects the beginning of a command word from MPU 30 (of FIG. 1). Upon the detection of the beginning of a command word, sync detector 4238 enables the serial-to-parallel converter 4232 to begin accumulating the address component and operation code bits from the input terminal 41. Decoder 4234 decodes the address component and operation code and generates the appropriate enable signals for the remainder of the bus interface circuit (of FIG. 3). Decoder 4234 may, for example, be a read-only memory (ROM) having an address input terminal coupled to the output terminal DO of the serial-to-parallel converter 4232 and having a data output terminal coupled to the input terminal of latch 4236. The ROM may be preprogrammed so that appropriate output terminals are enabled in response to the associated input address component and operation code. Such a technique is known in the art and will not be discussed in more detail. Latch 4236 latches the output of the decoder 4234 thus maintaining the value of the various enable signals through the remainder of the read or write cycle.

Figure 5:
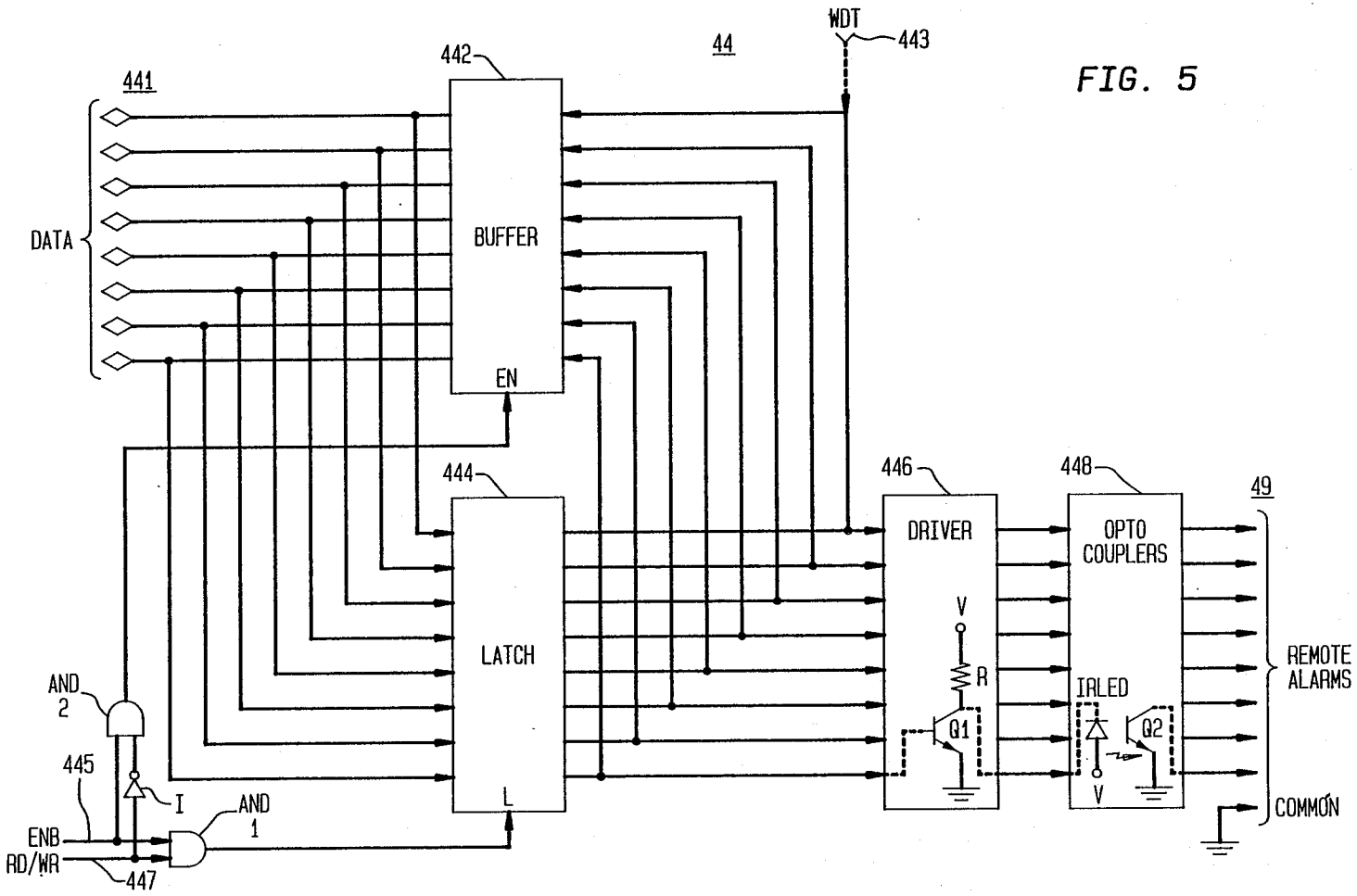
FIG. 5 is a more detailed block diagram of a coupler circuit which may be used in the remote alarm reporting unit illustrated in FIG. 2.

FIG. 5 is a more detailed block diagram of a coupler circuit 44 as illustrated in FIG. 2. In FIG. 5, multibit parallel bi-directional data terminals 441 are illustrated as 8 parallel-connected single-bit lines and are coupled to the bi-directional data terminal of bus interface circuit 42 (of FIG. 2). Data terminals 441 are coupled to respective input terminals of a latch 444 and respective output terminals of a buffer 442. Output terminals of latch 444 are coupled to respective input terminals of buffer 442 and respective input terminals of a driver circuit 446. Output terminals of driver circuit are coupled to respective input terminals of an optoelectric coupler circuit 448. Output terminals optoelectric coupler circuit 448 are coupled to respective remote alarm output terminals 49.

An enable input terminal 445 is responsive to one of the enable signals (ENB1–ENB4) from bus interface circuit 42, and is coupled to respective first input terminals of AND gates AND1 and AND2. A read/write input terminal (RD/WR) 447 is coupled to a second input terminal of AND gate AND1 and an input terminal of inverter I. An output terminal of inverter I is coupled to a second input terminal of AND gate AND2. An output terminal of AND gate AND1 is coupled to a latch input terminal (L) of latch 444 and an output terminal terminal of AND gate AND2 is coupled to an enable input terminal (EN) of buffer 442.

In operation, if the signal at the enable input terminal 445 is a logic "0" signal, then the coupler circuit 44 is not selected and no operation is performed. In this case, the first input terminals of AND gates AND1 and AND2 are both logic "0" signals. The output signals of AND gates AND1 and AND2 are, thus, logical "0" signals. In response, neither the latch 444 nor the buffer 442 are enabled.

If the signal at the enable input terminal 445 is a logic "1" signal, indicating that this optical coupler 44 is enabled, then the first input terminals of AND gates AND1 and AND2 are both logic "1" signals and both AND gates are enabled. In this case, either a read or a write operation will be performed depending upon the state of the signal at the RD/WR input terminal 447. If the signal at the RD/WR input terminal 447 is a logic "1" signal, indicating a write operation, then the output terminal of AND gate AND1 produces a logic "1" signal. The logic "1" signal from AND gate AND1 causes latch 444 to latch the data at the bi-directional data terminal 441 into the latch 444. The signal at the output terminal of inverter I is a logic "0" signal causing AND gate AND2 to produce a logic "0" signal, leaving buffer 442 in its unenabled condition.

If the signal at the read/write input terminal 447 is a logic "0" signal, indicating a read operation, then the output terminal of AND gate AND1 produces a logic "0" signal thereby disabling latch 444 The output of terminal inverter I produces a logic "1" signal. In response, the output terminal of AND gate AND2 produces a logic "1" signal thereby enabling buffer 442 to couple the signal at the output terminal of latch 444 back to the bi-directional data terminal 441. In this way MPU 30 may read the status of the alarms currently active in this coupler circuit 44.

The output terminals of latch 444 control respective drive circuits in the driver 446. These drive circuits convert the logic signals from latch 444 into signals capable of driving the optical couplers in optocoupler 448. An exemplary drive circuit for one of the input lines is illustrated in FIG. 5. The complete driver circuit 446 may, for example, consist of an array of 8 such circuits, one for each line. The drive circuit consists of a transistor Q1 having a base electrode coupled to the output terminal from latch 444 an emitter electrode coupled to ground and a collector electrode coupled to a source of operating voltage V through a load resistor R. The collector electrode is also coupled to the output terminals of driver 446. This circuit is capable of sinking a relatively large amount of current between the source of operating voltage and ground when the transistor is turned on.

The optocoupler 448 may consist of 8 pairs of optically coupled infrared light emitting diodes (IRLED) and phototransistors. An exemplary LED/phototransistor pair is illustrated in FIG. 5. An IRLED has a first terminal coupled to the source of operating voltage and a second terminal coupled to the input terminal of optocoupler 448. The polarity of the IRLED is arranged such that when the input terminal is coupled to ground (as through the driver circuit 446 described above), the IRLED emits IR light. The associated phototransistor Q2 has an emitter electrode coupled to ground, and a collector electrode coupled to the output terminal of optocoupler 448. In response to IR light from the IRLED, the phototransistor becomes conductive. The remote alarm terminal 49 coupled to that transistor then sees a low impedance path to ground. If no light is being emitted by the IRLED, then the associated phototransistor becomes nonconductive. In that case, the output terminal 49 sees a high impedance. These outputs therefore simulate relay contacts without the mechanical complexity and slower speed associated with relays.

A WDT input terminal 443 (in coupler 44A only) is coupled to the WDT output terminal of bus interface circuit 42 (of FIG. 2). This terminal (shown in phantom) is coupled to one input terminal of driver circuit 446. In the phantom arrangement, no connection is made between that input terminal and the corresponding output terminal of latch 444, nor between that input terminal and the corresponding input terminal of buffer 442. In this way, the status of the MPU30 (of FIG. 1) may be reported directly to the remote diagnostic tester 50 (of FIG. 1), as described above.

What is claimed is:

1. A telecommunication system, comprising:

a plurality of functional units, each producing a status signal;

a maintenance processor, coupled to said functional units, for receiving said status signals and producing signals representative of said status signals wherein said processor transmits said status representative signals as successive signals over a bus; and a remote alarm reporting unit, coupled to said processor, for generating optically isolated alarm signals corresponding to said status representative signals, comprising:

a bus interface circuit, coupled to said bus, for extracting said status representative signals;

a plurality of optical couplers for producing said alarm signals; and means, coupled between said bus interface circuit and said optical couplers, for controlling a selected one of said optical couplers in response to the value of a corresponding one of said successive status representative signals.

2. The system of claim 1, wherein:

said maintenance processor further requests signals representative of the alarm signals from said remote alarm reporting unit;

said controlling means further comprises means for producing signals representing the current state of said alarm signals and means for coupling said alarm representative signals to said bus interface circuit in response to said request from said maintenance processor; and said bus interface circuit further comprises means for coupling said alarm representative signals to said bus.

3. The system of claim 1, wherein said maintenance processor produces repetitive signals during proper operation, and said remote alarm reporting unit further comprises:

means, having an input terminal responsive to said repetitive signals, for producing a signal indicative of the absence of said repetitive signals; and means for coupling said indicative signal producing means to one of said optical couplers.

4. The system of claim 1, wherein said maintenance processor further produces a local alarm representative signal, and said remote alarm reporting unit comprises:

an optical signalling device; and means for lighting said optical signalling device in response to said local alarm signal.

5. The system of claim 1, wherein each of said optical couplers comprise:

a light emitting diode, coupled to said controlling means, configured to emit light in response to said corresponding one of said successive status representative signals; and a phototransistor, optically coupled to said light emitting diode, being rendered conductive when said light emitting diode is emitting light, and being rendered nonconductive when said light emitting diode is not emitting light.

6. The system of claim 5, wherein said light emitting diode is an infrared light emitting diode.

7. The system of claim 1, wherein:

said bus is a bit serial bus and said status representative signals are bit serial signals;

said bus interface circuit comprises means, coupled to said bus, for converting said bit serial status representative signals into multibit parallel signals and coupling said parallel status representative signals to a plurality of data signal lines; and said plurality of optical couplers are coupled to mutually different ones of said plurality of data signal lines.

8. The system of claim 7, wherein said maintenance processor further requests signals representative of the alarm signals from said remote alarm reporting unit;

said controlling means further comprises means for producing multibit parallel signals representing the current state of said alarm signals and means for coupling said parallel alarm representative signals to said plurality of data signal lines in response to said request from said processor; and said bus interface circuit further comprises means for converting said parallel alarm representative signals into bit serial signals and means for coupling said bit serial alarm representative signals to said bus.

9. The system of claim 8, wherein said controlling means further comprises:

a signal latch having a multibit digital data input terminal coupled to said plurality of data signal lines, and a multibit digital data output terminal coupled to said optical couplers; and means for conditioning said latch to latch data in response to the presence of status representative signals on said data signal lines; and wherein said parallel alarm signal producing means comprises:

a buffer circuit, having an input terminal coupled to said output terminal of said signal latch, and an output terminal coupled to said data signal lines; and means for configuring said buffer to couple the signals at said input terminal to said output terminal in response to said request from said maintenance processor.

10. The system of claim 7, wherein said controlling means comprises:

a signal latch having a multibit digital data input terminal coupled to said plurality of data signal lines, and a multibit digital data output terminal coupled to said optical couplers; and means for conditioning said latch to latch data in response to the presence of status representative signals on said data signal lines.

11. The system of claim 10, wherein said controlling means further comprises means, coupled between said signal latch and said optical couplers, for producing drive signals for said optical couplers.

12. The system of claim 11, wherein said drive signal producing means comprises a plurality of transistors, each having a base electrode coupled to a respective bit of said multibit output terminal of said signal latch, an emitter electrode coupled to a source of reference potential, and a collector coupled to a source of operating voltage through a load resistor.

13. The system of claim 12, wherein said optical coupler comprises:

a light emitting diode, having a first electrode coupled to said collector electrode of a corresponding one of said plurality of transistors of said drive signal producing means, and a second electrode coupled to one of said sources of reference potential and operating voltage, configured for emitting light in response to a drive signal from said drive signal producing means, and for not emitting light otherwise; and a phototransistor, optically coupled to said light emitting diode and having an emitter electrode coupled to said source of reference potential, and a collector for producing said alarm signal.

14. The system of claim 13, wherein said light emitting diode is an infrared light emitting diode.

* * * * *